United States Patent [19]

Myer

[11] Patent Number: 4,627,256

[45] Date of Patent: Dec. 9, 1986

[54] METHOD OF FORMING PRECISELY CURVED SURFACES

[75] Inventor: Jon H. Myer, Woodland Hills, Calif.

[73] Assignee: Hughes Aircraft Company, Los Angeles, Calif.

[21] Appl. No.: 106,985

[22] Filed: Dec. 26, 1979

[51] Int. Cl.[4] ..... B21D 26/02; B21D 22/10

[52] U.S. Cl. ..... 72/60; 29/421 R; 72/351

[58] Field of Search ..... 72/60, 63, 58, 59, 350, 72/351, 379, 54, 297, 378; 29/421 R

[56] References Cited

U.S. PATENT DOCUMENTS

| | | | |
|---|---|---|---|
| 15,278 | 7/1858 | Booth | 72/351 |
| 138,721 | 5/1873 | Wilson et al. | 72/351 |
| 1,881,517 | 10/1932 | Groehn | 72/350 |
| 2,285,903 | 6/1942 | Clark | 72/350 |
| 2,292,462 | 8/1942 | Milford | 72/60 |
| 2,344,743 | 3/1944 | Smith | 72/63 |
| 2,410,857 | 11/1946 | Ahern | 72/60 X |
| 2,728,317 | 12/1955 | Clevenger et al. | 72/60 |
| 2,961,028 | 11/1960 | Bath | 72/297 |
| 3,073,373 | 1/1963 | Wheeler et al. | 72/297 |
| 3,093,086 | 6/1963 | Altoz et al. . | |
| 3,299,689 | 1/1967 | Dolney | 72/350 X |
| 3,435,653 | 4/1969 | Scaletta et al. | 72/351 X |
| 3,529,458 | 9/1970 | Butler et al. | 72/60 |
| 3,751,956 | 8/1973 | Blanchl | 72/351 |
| 4,045,986 | 9/1977 | Laycock et al. | 29/421 R |
| 4,211,102 | 7/1980 | Hurvitz | 72/378 |

*Primary Examiner*—E. Michael Combs

*Attorney, Agent, or Firm*—Lewis B. Sternfels; A. W. Karambelas

[57] ABSTRACT

Precisely curved, lightweight and low-cost reflectors for electromagnetic radiation are fabricated by use of a tool and a process in which a blank is planar stretched by uniformly applied isotropic and radially extending forces followed by deformation of the stretched blank to a precisely curved surface.

14 Claims, 15 Drawing Figures

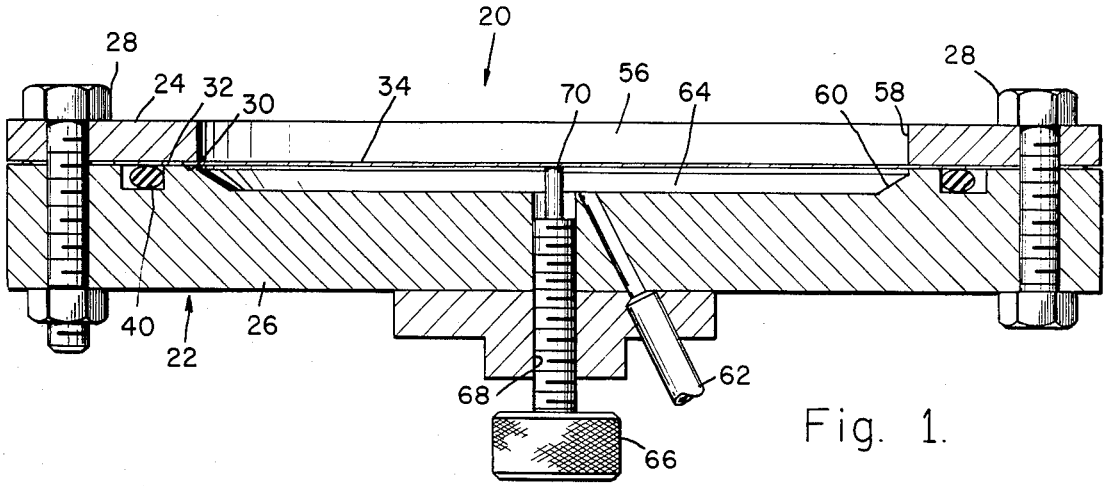
Fig. 1.
Fig. 2.
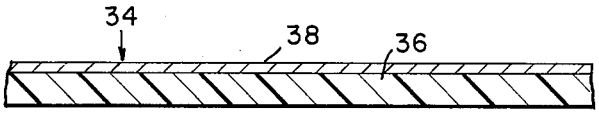
Fig. 3.
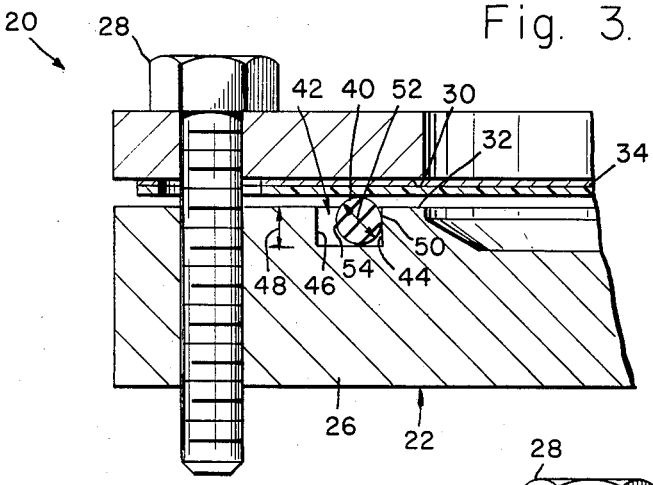
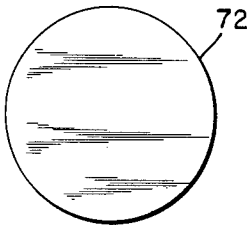
Fig. 5.
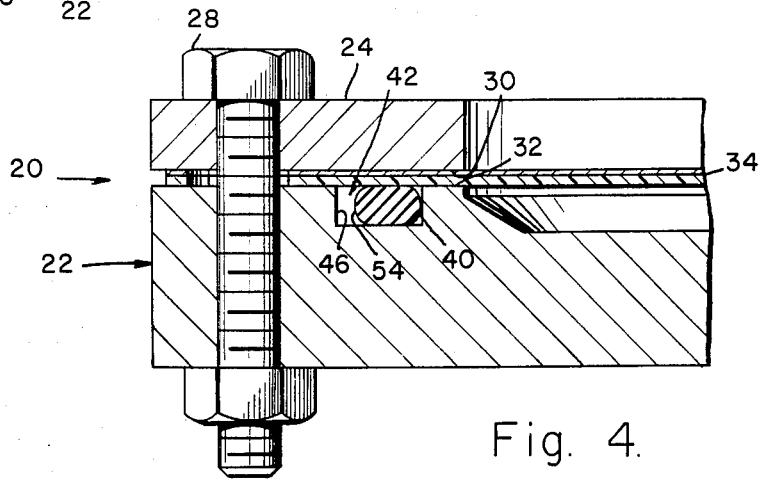
Fig. 4.

METHOD OF FORMING PRECISELY CURVED SURFACES

BACKGROUND OF THE INVENTION

1. Field of the Invention

The present invention relates to a method and tool for forming precisely curved surfaces, in particular, useful for reflectors of electromagnetic radiation and microwave antennas.

2. Description of the Prior Art

Such reflectors and antennas conventionally are produced in a tedious and costly manner. For example, fabrication of a reflector having a parabolic surface, such as is used in reflector telescope mirrors, requires time-consuming optical polishing of glass or ceramic substrates and subsequent metallizing, and include refined grinding and polishing techniques. Alternate techniques, like centrifugal casting on a rotating turntable, contour turning on a tracer lathe, and plastic injection molding in optical precision molds, have been successfully employed in the past. These manufacturing techniques involve high costs as a result of high labor content and/or expensive tooling. In a like manner, other reflectors are produced by costly electro-forming or precision casting techniques.

Further techniques for shaping articles may be classified among that art relating to stretch and die forming of metal stock, as typified by U.S. Pat. No. 2,961,028, and that to plastic reinforced reflectors and antennas as shown in U.S. Pat. Nos. 3,337,660; 3,374,482; 3,658,971 and 3,897,294. U.S. Pat. No. 2,961,028 preconditions stock by stretching it above its elastic limit to render it more flowable and plastic before being work-hardened as it is formed between matching surfaces of drawing dies. In U.S. Pat. No. 3,337,660 a thin circular diaphragm or membrane, which is clamped around its periphery, is stretched beyond its elastic limit by differential pressure, after which a solidifiable substance, such as an epoxy resin or a polyurethane foam, is poured onto and hardened on the diaphragm. U.S. Pat. No. 3,374,482 molds a foamed-in plastic onto a preformed metallized reflective surface. U.S. Pat. No. 3,658,971 describes a process wherein a foamable composition is injected within a cavity closed by an adhesived strip. Knife edges about the mold peripheries of the cavity sever the adhesived strip upon completion of the expansion of the foamable material, to enable removal of the molded article. U.S. Pat. No. 3,897,294 describes an involved method of forming a parabolic antenna reflector provided with machined slots and holes for receipt of a waveguide feedhorn, and mounting structure for a hyperbolic surface. The parabolic reflector is formed, in part, from a flat copper or copper plastic sheet which is subjected to pressure exerted by a specially prepared paraboloid and mold ring.

These prior art devices are incapable of producing precision reflectors and antennas in that the stretching forces exerted on the materials are anisotropic, i.e., not extending equally in all directions across the surface of the material, which result in astigmatism of the deformed surface. Freeblown shapes also suffer from large aberrations and uncontrolled focal length.

SUMMARY OF THE INVENTION

The present invention avoids or overcomes the above problems or shortcomings of the prior art by sequential isotropic planar stretching and stretch forming of a blank or membrane. The curvature is obtained by hydraulic or pneumatic stretch forming either without contraints or over a precision mandrel template. Thereafter, the blank is capable of being structurally supported. Where needed, precise perforations are incorporated in the formed blank.

It is, therefore, an object of the present invention to provide a process and tool for producing precisely curved, lightweight, low-cost reflectors and antennas.

Another object is to provide for such a process and tool which avoids the introduction of deformations resulting from anisotropically exerted forces on the reflector or antenna surface.

Another object of the present invention is to provide for such a process and tool which is capable of imparting any desired contour to such a surface.

Other aims and objects as well as a more complete understanding of the present invention will appear from the following explanation of exemplary embodiments and the accompanying drawings thereof.

BRIEF DESCRIPTION OF THE DRAWINGS

FIG. 1 depicts a tool for forming freeblown curved axicon surfaces;

FIG. 2 is an enlarged view of a section of the membrane or diaphragm of FIG. 1;

FIGS. 3 and 4 depict means for clamping and isotropically stretching the membrane;

FIG. 5 is a view of the reflective side of the surface shown in FIG. 1 when perfectly flat;

DETAILED DESCRIPTION OF THE INVENTION

Figure 6:
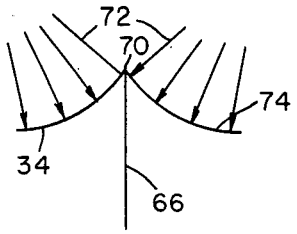
FIGS. 6–10 illustrate various configurations of the membrane depending the exertion of positive or negative forces thereon in conjunction with a central adjustable mechanical point support.

The principal surfaces which can be generated by use of the structure shown in FIGS. 1–10 have the shape of a spheroid and a spheroidal axicon. As defined herein, a spheroid is the surface described by the rotation of a sphere about its axis. An axicon is an optical element with a pyramidal surface of revolution. When inserted into a collimated beam of light, the axicon forms a beam in the form of a hollow cone. An axicon lens consists of a body with one surface which is flat and the opposite surface which is conical, not spherical.

Accordingly in FIG. 1, a tool 20 includes a holder 22 comprising a clamping ring flange 24 and a clamp base flange 26 secured together by any suitable attachment, such as nuts and bolts 28 equally spaced about the periphery of the holder. Clamping ring 24 and clamp base 26 respectively have clamping surfaces 30 and 32 which, when pressed by attachments 28 securely hold a deformable diaphragm 34 therebetween. To be reflective, the diaphragm may comprise, for example as shown in FIG. 2, an elastic polyester film 36 having an aluminized surface 38 thereon, or a plastically deformable copper sheet. Alternatively, the diaphragm may be only of a plastically deformable material with a reflective coating to be placed thereon after it has been precisely curved.

Prior to being deformed into a precision curved surface, diaphragm 34 must be made perfectly flat by being radially and isotropically stretched. To ensure this condition, it is first prestretched by holder 22. Stretching is accomplished by use of an O-ring 40 which is caused to be uniformly expanded outwardly while applying frictional forces on the diaphragm.

The procedure for doing so is depicted in FIGS. 3 and 4 and requires a particular relationship of parts. Specifically, an annular recess or groove 42 is formed in one of either clamping ring 24 or clamp base 26, for convenience, here shown as located within the clamp base. The annular recess has an inner diameter 44, an outer diameter 46 and a depth 48. The dimensions of annular recess 42 are related to those of O-ring 40, such that the O-ring has an inner diameter 50 which is approximately equal to inner diameter 44 of annular recess 42, and a thickness 52 which is both greater than depth 48 of the annular recess and is less than the distance between inner and outer diameters 40 and 46 of the annular recess. As a result a space exists between outer diameter 54 of the O-ring and outer diameter 46 of the annular recess.

The tool and diaphragm are assembled by inserting the O-ring into recess 42, diaphragm 34 on the O-ring and clamping ring 24 on the diaphragm. When O-ring 40 is clamped between ring 24 and base 26 by nuts and bolts 28, the clamping ring and clamp base move towards one another and O-ring 40 is compressed. Because its inner diameter 50 is constrained from movement through its contact with inner diameter 44 of the annular recess, it must move radially outwardly toward recess outer diameter 46. Inasmuch as the O-ring frictionally engages membrane 34, it drags the membrane radially outwardly. To facilitate radial movement during stretching, it is advisable to lubricate the flat area opposite the O-ring to reduce the friction forces on the expanding diaphragm. Because the O-ring is annularly configured, the radially extending forces exerted on membrane 34 are isotropic, i.e., all radially extending stretching forces are equally applied from the O-ring's center. At the point where full clamping occurs between surfaces 30 and 32 of clamping ring 24 and clamp base 26, outer diameter 54 of O-ring 40 still remains slightly spaced from outer diameter 46 of the annular recess, as depicted in FIG. 4. Thus, membrane 34 is freely supported by holder 22 and is stretched perfectly flat within a central space 56 of tool 20, defined by internal surfaces 58 and 60, respectively of clamping ring 24 and clamp base 26. A reflection from illuminated surface 38 of diaphragm 34 would have the general appearance illustrated in FIG. 5.

If a positive pressure were applied to diaphragm 34, it would assume a convex spheroidal shape such as depicted in above-noted U.S. Pat. No. 3,337,660. A concave spheroidal configuration is obtainable if a negative pressure were exerted upon diaphragm 34. Both positive and negative pressures are derived from a source acting through a conduit 62, which extends through clamp base 26 and is coupled to a closed inner space 64 defined by internal surfaces 60 of the clamp base and film 36 of diaphragm 34.

Figure 7:
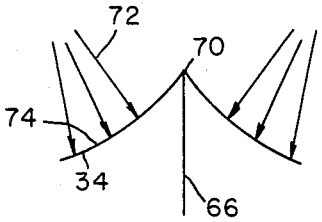
Figure 8:
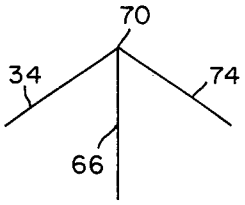
Figure 9:
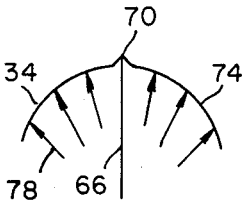
Figure 10:
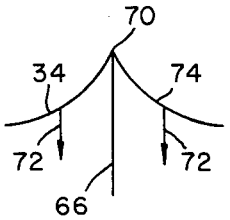

In order to provide the necessary central support required to further configure diaphragm 34, specifically into an axicon, a screw 66, e.g., a micrometer screw, has a threaded engagement 68 with clamp base 26. The screw is in point contact with, and supports, the center of diaphragm 34 at its tip 70. Depending on the position of screw 66 and the positive or negative pressure applied on diaphragm 34, the invention as thus far described operates as a zoomable focusing axicon, in which its cone angle is adjusted by the position of micrometer tip 70, and the focal length of the surface is adjusted by the vacuum or pressure applied to the membrane. FIGS. 6, 7 and 10 depict various combinations of vacuum (represented by arrows 72) and micrometer screw adjustments. FIG. 8 depicts membrane 34 deformed solely by forward movement of the micrometer screw and FIG. 9 depicts the combined use of positive pressure (represented by arrows 78) and forward movement of screw 66.

FIGS. 11–15 illustrate a process and mechanization whereby a blank 80, e.g. of thin plastically deformable copper foil, may be permanently deformed and thereafter fixed in position by application of a rigidized backing thereto.

Figure 11:
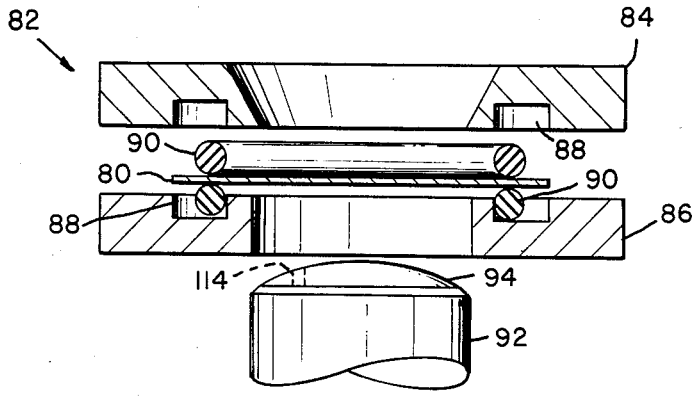
FIGS. 11–15 depict a series of steps whereby a permanently deformable blank may be contoured to form a precision curved surface supported by backing structure.
Figure 12:
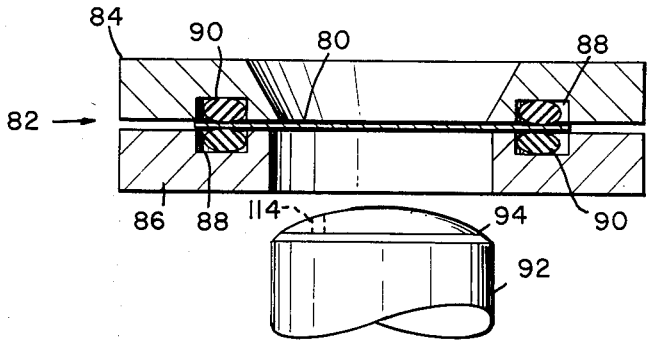

FIG. 11 depicts the assembly of a holder 82 comprising a pair of clamping rings 84 and 86. To permit the application of larger radial forces, both clamping rings are respectively provided with annular recesses 88 in which respective O-rings 90 are placed. The physical dimensions and relationships existing between the respective O-rings and their annular recesses is the same as that described with respect to single O-ring 40 and annular recess 42 in the version shown in FIGS. 1, 3 and 4. In a like manner, therefore, O-rings 90 engage both sides of diaphragm 80, as distinguished from engagement with a single side of diaphragm 34, so that diaphragm 80 has substantially twice the isotropic and radially extending forces applied thereto as clamping rings 84 and 86 are brought together as depicted in FIG. 12. At this point, the completion of the planar stretching process on blank 80 is completed and the blank is readied for impartation thereto of a precise curved surface.

Figure 13:
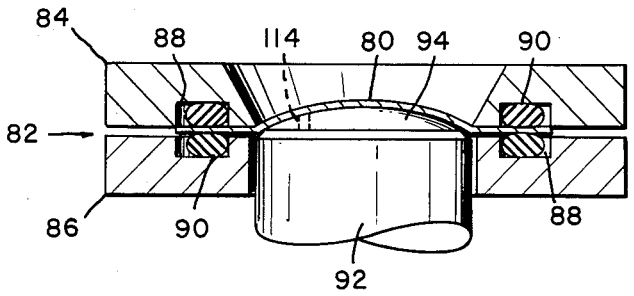

The pattern for such a precise surface is configured as an optically contoured face 94 on a mandrel template 92. This contour is transferred to blank 80 after the blank has been stretched into perfect flatness. Specifically, mandrel 92 is advanced toward and into deforming contact with the blank as shown in FIG. 13 to impress the desired optical curvature upon blank 80.

To form a proper backing for the blank (see FIG. 14) a dam tube 96 is placed up against the periphery of precisely curved blank 80 and a mold ring 98 is placed against tube 96. Prior to their placement, a non-stick substance is applied to the interior surfaces of the dam tube and the mold ring. A backing material, preferably comprising a supporting structural foam 102 is placed within the cavity formed by dam tube 96 and mold ring 98, and a cover plug 104 is then inserted into the opening of the mold ring so that the structural supporting foam will be captured within the closed cavity and expand with pressure therein.

Figure 15:
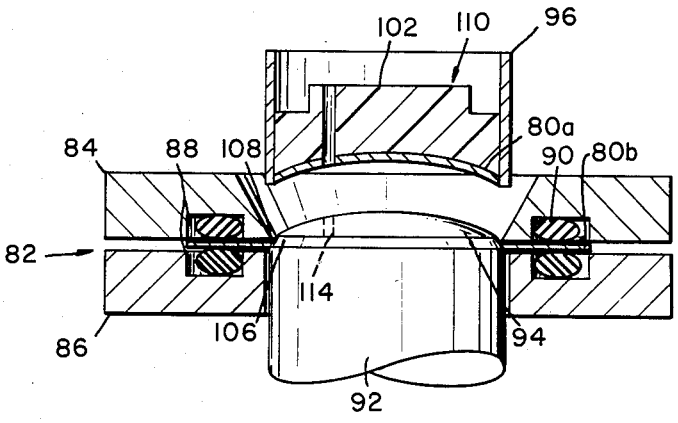

After the foam has cured, additional force is applied to the mandrel template, shearing off all peripheral excess copper foil. Dam tube 96, mold ring 98 and cover plug 104 are then removed with the foam structure contained therein. This shearing separation is depicted in FIG. 15 and comprises the use of a tapered periphery 106 on mandrel 92 adjacent its optically contoured face 94, and a sharp edge 108 on clamping ring 84 which slightly overhangs clamping ring 86. In operation, mandrel 92 is caused to advance further so that the foil is pinched between tapered periphery 106 of the mandrel and sharp edge 108 on clamping ring 84 to shear the completed optical component 110 and its curved foil component 80*a* from the peripheral excess foil 80*b* to complete the process. Dam tube 96, mold ring 98 and plug 104 are then removed from the completed product.

Figure 14:
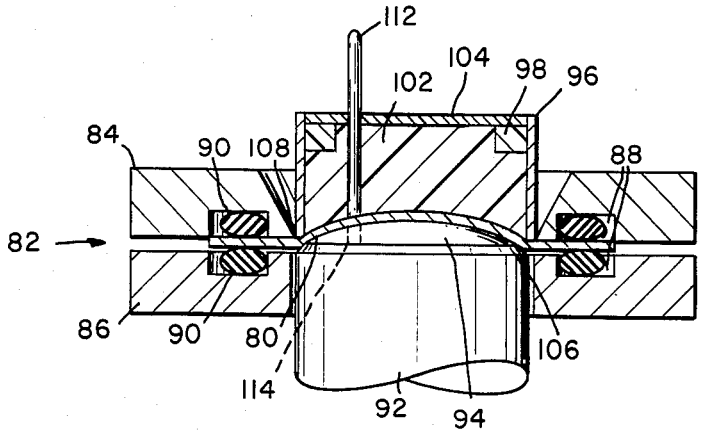

The present invention also permits inclusion of a waveguide or other transmitting apparatus which must be extended through the completed article. An opening for such inclusion may be formed, as also shown in FIGS. 14 and 15, with the aid of a feedhole punch 112. The punch is supported in the assembly and extends through cover plug 104 into contact with blank 80, in line with a receiving hole 114 in mandrel 92. Foam 102, as previously described, is then placed within the cavity defined by tube 96, mold ring 98 and cover 100. The feedhole punch is then driven through blank 80 before curing of foam 102 is complete. After full curing of the foam, punch 112 is removed, followed by separation of formed surface 80*a* from its peripheral excess foil 80*b* and removal of the container accessories (tube 96, mold ring 98 and plug 104).

A typical reflecting surface was fabricated using the following process steps. A press assembly including holder 82 was heated to 45° C. All metal washer debris were removed from all recesses including that in which the feedhole punch was to travel. After all parts were cleaned, a release agent was sprayed on the taper of clamp cutter ring 108, cylinder edge 106 and feedhole punch 112. O-rings 90, after being washed in acetone to maximize their frictional engaging properties, were installed in recesses 88. Tube 96 and ring 98 also were sprayed with the release agent and assembled. Any remaining areas which might have come in contact with the foam backing further were sprayed with the release agent. The copper foil was then cut to a generally circular pattern to define a blank 80 and the blank was washed with acetone to assure good bonding to the foam. Forming piston or mandrel 92 was then checked to be in its retracted position and blank 80 was installed on top of the O-ring on clamping ring 86. Clamping ring 84 and its O-ring were then installed atop copper blank 80 and rings 84 and 86 were secured together in any convenient manner, such as by means of nuts and bolts as depicted in FIG. 4. A clamping force of 4,000 psi was applied between the clamping rings and the pressure was kept constant. Mandrel 92 was then slowly advanced until a pressure of 1,000 psi was applied to the blank, and then held constant. Feedhole punch 112 was placed in position and advanced to form a feedhole pilot hole in blank 80. Dam tube 96 and ring 98 were then installed. Suitable amounts of FPH resin and catalyst 12-4H were mixed together until they became clear and foaming began. When the heat from the exothermic reaction became noticeable, the mixture was emptied into the cavity formed by dam tube 96, and cover plug 104 was then inserted and securely affixed to ring 98, dam 96 and blank 82. After a period of approximately five minutes, mandrel 92 was further advanced to increase the pressure to 5,000 psi to pinch the blank between periphery 106 and cutting edge 108. Feedhole punch 112 was then completely driven into the mandrel to complete formation of the hole through reflective base 80*a*. After an additional thirty minute period while the pressures were held, the feedhole punch was removed and the pressures on mandrel 92 and between ings 84 and 86 were released. The product was then lifted out and readied for assembly in the equipment for which it was intended.

Although the invention has been described with reference to particular embodiments thereof, it should be realized that various changes and modifications may be made therein without departing from the spirit and scope of the invention.

What is claimed is:

1. A method for forming a precisely curved surface comprising the sequential steps of applying substantially uniform isotropic and radially extending forces upon a substantially planar plastically deformable blank, and plastically deforming the blank to permanently form the precisely curved surface.

2. A method for forming a precisely curved surface comprising the sequential steps of:

positioning a substantially planar blank between a pair of claiming rings in which at least one clamping ring includes an annular recess facing the blank adjacent its edge periphery;

utilizing at least one O-ring having a thickness greater than the depth of the annular recess, an inner diameter which is approximately equal to the inner diameter of the annular recess and an outer diameter which is smaller than the outer diameter of the annular recess;

placing the O-ring in the annular recess;

bringing the clamping rings together to compress and expand the O-ring towards the outer diameter of the annular recess and to frictionally drag the blank outwardly therewith, to apply substantially uniform isotropic and radially extending forces on the blank; and deforming the blank into the surface.

3. A method according to claim 2 further comprising the step of mechanically clamping opposed sides of the blank between peripheral surfaces on the rings adjacent the O-ring after applying the isotropic and radially extending forces on the blank.

4. A method for forming a precisely curved surface comprising the sequential steps of applying substantially uniform isotropic and radially extending forces upon a substantially planar plastically deformable blank, and plastically deforming the blank by exerting a unidirectional, generally normally extending pressure upon the blank to permanently form the precisely curved surface.

5. A method according to claim 4 wherein said pressure exerting step comprises the step of exerting a positive pressure upon the blank.

6. A method according to claim 5 wherein said positive pressure exerting step comprises the step of advancing a mandrel, having a face contoured to define the precisely curved surface, into contact with the blank for effecting said plastically deforming step.

7. A method according to claim 6 further comprising the step of securing a rigid backing to the precisely curved surface.

8. A method according to claim 7 wherein said securing step comprises the step of molding a foamable resin as the rigid backing to the precisely curved surface.

9. A method according to claims 7 or 8 wherein the blank is positioned at its periphery adjacent a cutting edge and further comprising the step of advancing the mandrel further against the precisely curved surface and into pinching contact with the cutting edge to shear the blank periphery from the precisely curved surface.

10. A method for forming a precisely curved surface comprising the sequential steps of applying substantially uniform isotropic and radially extending forces upon a substantially planar plastically deformable blank, and plastically deforming the blank by exerting a force upon the blank generally localized at its center to permanently form the precisely curved surface with a conical configuration.

11. A method according to claim 10 wherein said deforming step further comprises the step of exerting a negative pressure upon the blank to form a shape therefrom generally configured as a spheroidal axicon.

12. A method according to claim 11 in which the blank comprises an elastic diaphragm having a reflective surface thereon, further comprising the steps of adjusting the cone angle of the spheroidal axicon by increasing or decreasing the force exerted on the diaphragm blank's center, and adjusting the focal length of the surface by the degree of positive or negative pressure exerted on the diaphragm blank.

13. A method for forming a precisely curved surface from a blank capable of taking a permanent set when stretched beyond its elastic limit comprising the sequential steps of:

positioning the periphery of the blank between a pair of clamping rings in which each includes an annular recess respectively facing one another;

respectively placing in the annular recesses O-rings whose respective thicknesses are greater than the respective depths of their respective annular recesses, whose respective inner diameters are approximately equal to the respective inner diameters of their respective annular recesses and whose respective outer diameters are smaller than the respective diameters of their respective annular recesses;

bringing the two clamping rings together for compressing and expanding the O-rings towards the outer diameters of their respective annular recesses and, consequently, for applying the radially extending forces on both sides of the blank;

advancing a mandrel, having a face contoured to define the precisely curved surface, into contact with the blank for stretching it beyond its elastic limit and thus to form the curved surface; and further advancing the mandrel against the precisely curved surface and into pinching contact with a cutting edge to shear the blank periphery from the precisely curved surface.

14. A method according to claim 13 further including the steps of positioning the mandrel adjacent one of the clamping rings and placing the cutting edge on the other of the clamping rings in line with the periphery of the contoured face of the mandrel.

* * * * *